US009499179B2

(12) United States Patent
Hirashima et al.

(10) Patent No.: US 9,499,179 B2
(45) Date of Patent: Nov. 22, 2016

(54) RAILROAD VEHICLE PROVIDED WITH LOW ROOF STRUCTURE

(71) Applicant: KAWASAKI JUKOGYO KABUSHIKI KAISHA, Kobe-shi, Hyogo (JP)

(72) Inventors: Toshiyuki Hirashima, Kobe (JP); Seiichi Hayashi, Oshima-gun (JP); (Continued)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/351,774

(22) PCT Filed: Feb. 25, 2013

(86) PCT No.: PCT/JP2013/001074

§ 371 (c)(1),
(2) Date: Apr. 14, 2014

(87) PCT Pub. No.: WO2013/125250

PCT Pub. Date: Aug. 29, 2013

(65) Prior Publication Data

US 2014/0250800 A1 Sep. 11, 2014

(30) Foreign Application Priority Data

Feb. 23, 2012 (JP) ..... 2012-037019

(51) Int. Cl.

| | |
|---|---|
| ***B61D 17/12*** | (2006.01) |
| ***B61D 27/00*** | (2006.01) |
| ***B61D 17/00*** | (2006.01) |

(52) U.S. Cl.
CPC ..... *B61D 17/12* (2013.01); *B61D 17/005* (2013.01); *B61D 27/00* (2013.01); *B61D 27/0018* (2013.01)

(58) Field of Classification Search
CPC ..... B61D 17/12; B61D 17/005; B61D 27/0018; B61D 27/00
(Continued)

(56) References Cited

U.S. PATENT DOCUMENTS 2,589,997 A * 3/1952 Dean et al. ..... 105/340
2,595,212 A * 4/1952 Ledwinka et al. ..... 105/401
(Continued)

FOREIGN PATENT DOCUMENTS

JP A-55-145016 11/1980
JP U-57-108413 7/1982
(Continued)

OTHER PUBLICATIONS

International Search Report issued in International Application No. PCT/JP2013/001074 dated May 21, 2013.
(Continued)

*Primary Examiner* — James Ference
(74) *Attorney, Agent, or Firm* — Oliff PLC

(57) ABSTRACT

A railroad vehicle where an air conditioner can be installed in an upper part of a roof thereof includes a roof structure having an opening, and a low roof main body having a recessed part provided in the opening, and recessed in a cross section, the air conditioner being able to be placed on the recessed part, and an edge part of the low roof main body which is continuously formed from the low roof main body and joined to the roof structure. The low roof main body and the edge part of the low roof main body are made of plastic.

14 Claims, 7 Drawing Sheets

(72) Inventors: Hitoshi Nagahara, Akashi (JP);
Yousuke Tsumura, Akashi (JP);
Osamu Muragishi, Akashi (JP)

(58) Field of Classification Search
USPC ..... 52/45, 46, 47, 48, 49, 50, 51, 52, 53, 52/54, 55, 56
See application file for complete search history.

(56) References Cited

U.S. PATENT DOCUMENTS

| | | | | |
|---|---|---|---|---|
| 2,719,489 | A * | 10/1955 | Dean | 105/62.2 |
| 3,159,089 | A * | 12/1964 | Eggert, Jr. | 454/99 |
| 4,201,064 | A * | 5/1980 | Krug et al. | 62/239 |
| 4,318,350 | A * | 3/1982 | Skypala | 105/397 |
| 4,319,528 | A * | 3/1982 | Gutridge et al. | 105/397 |
| 4,353,313 | A * | 10/1982 | Panagin | 105/397 |
| 4,607,497 | A * | 8/1986 | Ferdows et al. | 62/179 |
| 4,748,825 | A * | 6/1988 | King | B60H 1/00371 62/244 |
| 4,787,210 | A * | 11/1988 | Brown | B60H 1/00371 165/42 |
| 4,926,655 | A * | 5/1990 | King | 62/244 |
| 4,993,329 | A * | 2/1991 | Takeich et al. | 105/401 |
| 5,042,395 | A * | 8/1991 | Wackerle et al. | 105/397 |
| 5,140,913 | A * | 8/1992 | Takeichi et al. | 105/397 |
| 5,184,474 | A * | 2/1993 | Ferdows | 62/244 |
| 5,285,654 | A * | 2/1994 | Ferdows | 62/309 |
| 5,605,055 | A * | 2/1997 | Salgado | 62/244 |
| 5,632,330 | A * | 5/1997 | Drucker et al. | B60H 1/00321 165/125 |
| 5,791,156 | A * | 8/1998 | Strautman et al. | B60H 1/00364 296/38 |
| 5,916,093 | A * | 6/1999 | Fecko et al. | 52/17 |
| 5,934,739 | A * | 8/1999 | Waldeck | 296/178 |
| 5,988,074 | A * | 11/1999 | Thoman | 105/404 |
| 6,070,369 | A * | 6/2000 | Roesler et al. | 52/45 |
| 6,092,472 | A * | 7/2000 | Thoman et al. | 105/404 |
| 6,339,934 | B1 * | 1/2002 | Yoon et al. | B60H 1/00364 62/244 |
| 6,357,249 | B1 * | 3/2002 | Robinson et al. | B60H 1/00364 62/244 |
| 6,378,444 | B1 * | 4/2002 | Dastas et al. | 105/396 |
| 6,626,118 | B1 * | 9/2003 | Veit-Salomon et al. | 105/396 |
| 6,745,586 | B1 * | 6/2004 | Reimann et al. | 62/244 |
| 6,761,038 | B1 * | 7/2004 | Bushnell et al. | 62/244 |
| 6,761,840 | B2 * | 7/2004 | Fecko et al. | 264/31 |
| 8,033,899 | B2 * | 10/2011 | Ichikawa et al. | B60H 1/00378 296/39.3 |
| 2001/0009723 | A1 * | 7/2001 | Kawasaki et al. | 428/544 |
| 2002/0092888 | A1 * | 7/2002 | Ezumi et al. | 228/112.1 |
| 2002/0092889 | A1 * | 7/2002 | Ezumi et al. | 228/112.1 |
| 2002/0092890 | A1 * | 7/2002 | Ezumi et al. | 228/112.1 |
| 2002/0125298 | A1 * | 9/2002 | Ezumi et al. | 228/112.1 |
| 2003/0056684 | A1 * | 3/2003 | Nakamura et al. | 105/392.5 |
| 2004/0040463 | A1 * | 3/2004 | Yamamoto et al. | 105/396 |
| 2004/0089194 | A1 * | 5/2004 | Homes | 105/404 |
| 2006/0207471 | A1 * | 9/2006 | Todori et al. | 105/396 |
| 2006/0225604 | A1 * | 10/2006 | Nakamura et al. | 105/396 |
| 2007/0227396 | A1 * | 10/2007 | Nakamura et al. | 105/396 |
| 2008/0125926 | A1 * | 5/2008 | Mamoto et al. | 701/22 |
| 2010/0006257 | A1 * | 1/2010 | Schutz | 165/61 |
| 2011/0061414 | A1 * | 3/2011 | McAllister et al. | 62/244 |
| 2012/0067247 | A1 * | 3/2012 | Umebayashi et al. | 105/396 |

FOREIGN PATENT DOCUMENTS

| | | | |
|---|---|---|---|
| JP | U-63-173866 | | 11/1988 |
| JP | H01-141164 | A | 6/1989 |
| JP | U-5-20968 | | 3/1993 |
| JP | A-9-216560 | | 8/1997 |
| JP | A-2000-264199 | | 9/2000 |
| JP | A-2004-122962 | | 4/2004 |
| JP | A-2006-123685 | | 5/2006 |
| JP | 2007-253693 | A | 10/2007 |
| JP | A-2007-261345 | | 10/2007 |
| WO | WO 2010/143365 | A1 | 12/2010 |

OTHER PUBLICATIONS

Oct. 27, 2015 Office Action issued in Japanese Patent Application No. 2014-500607.

* cited by examiner

Fig. 6A
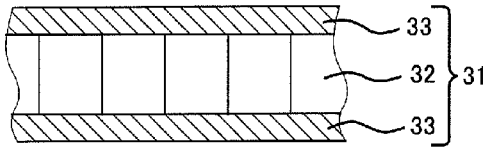
Fig. 6B
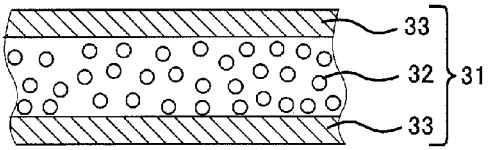
Fig. 6C
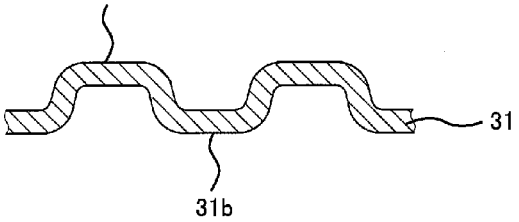
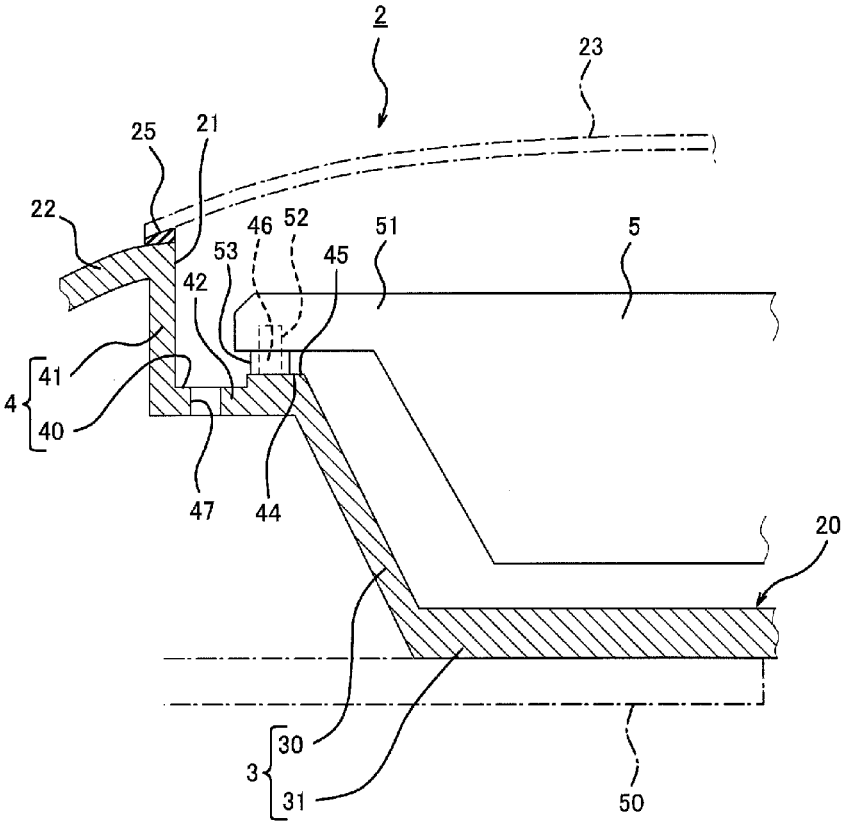
Fig. 7

RAILROAD VEHICLE PROVIDED WITH LOW ROOF STRUCTURE

TECHNICAL FIELD

The present invention relates to a railroad vehicle provided with a low roof structure.

BACKGROUND ART

A railroad vehicle is generally provided with a roof structure which constitutes the top of a vehicle body. In terms of restrictions of construction gauges and exterior designs, structures have been known, where an air conditioner or the like can be mounted by lowering the roof structure so that it is recessed toward a vehicle cabin from the external surface of the roof structure (refer to Patent Document 1). Hereinafter, the structural part which is lowered from other parts of the roof structure is referred to as a "low roof structure." The low roof structure disclosed in Patent Document 1 is made of an extruded aluminum alloy, which is comprised of a flat part on which the air conditioner is placed and rising parts which rise from both sides of the flat part in a width direction to join to side structures. The flat part is joined to the respective rising parts by welding or friction stir welding. Thus, in Patent Document 1, a reduction in strength and a reduction in a noise generation caused by the joining parts can be prevented, while facilitating an installation work.

REFERENCE DOCUMENT OF CONVENTIONAL ART

Patent Document

[Patent Document 1] JP2007-261345A

DISCLOSURE OF THE INVENTION

Problems to be Solved by the Invention

Meanwhile, since a large load or the like is less likely applied to the low roof structure itself, it is ideal to form the low roof structure into a thin-plate structure also in terms of reducing the entire weight of the railroad vehicle. However, since the low roof structure of Patent Document 1 uses a section bar material having a uniform cross section and is entirely thick, there is an inconvenience of becoming the trouble of the weight reduction. Further, since the roof structure is exposed to rain and wind, waterproofing or the like is required when using the low roof structure where the air conditioner or the like is placed. However, Patent Document 1 does not propose any waterproofing for the low roof structure. Thus, the purpose of the present invention is to provide a railroad vehicle with a low roof structure, particularly a low roof structure which can reduce the entire weight of the railroad vehicle and has a waterproof structure.

SUMMARY OF THE INVENTION

A railroad vehicle according to the present invention has a roof. An air conditioner is installable in an upper part of the roof. The railroad vehicle includes a roof structure having an opening, a low roof main body, provided in the opening and having at least one of a recessed part recessed in a cross section and a placing part where a pass hole is formed in a plan view, the air conditioner being able to be placed on an edge part of the at least one of the recessed part and the pass hole of the placing part, and an edge part of the low roof main body, continuously formed from the low roof main body and joined to the roof structure. The low roof main body and the edge part of the low roof main body are made of plastic. Note that the term "plastic" as used herein includes fiber-reinforced plastics, such as CFRP and GFRP, and various composite materials. According to the configuration, the weight of the low roof structure, that is, the entire weight of the railroad vehicle can be reduced by forming the low roof main body and its edge part from plastic. In addition, since the low roof main body and its edge part are made of plastic, even if the low roof main body has a complicated three-dimensional shape, dealing with this is easy.

Effect of the Invention

According to the present invention, the railroad vehicle provided with the low roof structure which can reduces the weight of the low roof structure, that is, the entire weight of the railroad vehicle, while having the waterproof structure, can be provided.

BRIEF DESCRIPTION OF THE DRAWINGS

FIGS. 6(*a*) to (*c*) are enlarged views of a section D of FIG. 3.

FIG. 7 is an enlarged view of a section E of FIG. 3.

MODES FOR CARRYING OUT THE INVENTION

1. Embodiment
   1-1. Outline of Entire Configuration
   1-2. Configuration of Low Roof Main Body
   1-3. Mounting Structure of Low Roof Main Body and Roof Structure
   1-4. Waterproof Construction of Low Roof Structure
   1-5. Method of Fitting Low Roof Main Body
2. Modification of Low Roof Main Body
3. Modification of Waterproof Structure of Low Roof Structure
4. Other Modifications
5. Effects of Each Configuration

1. Embodiment

1-1. Outline of Entire Configuration

Figure 1:
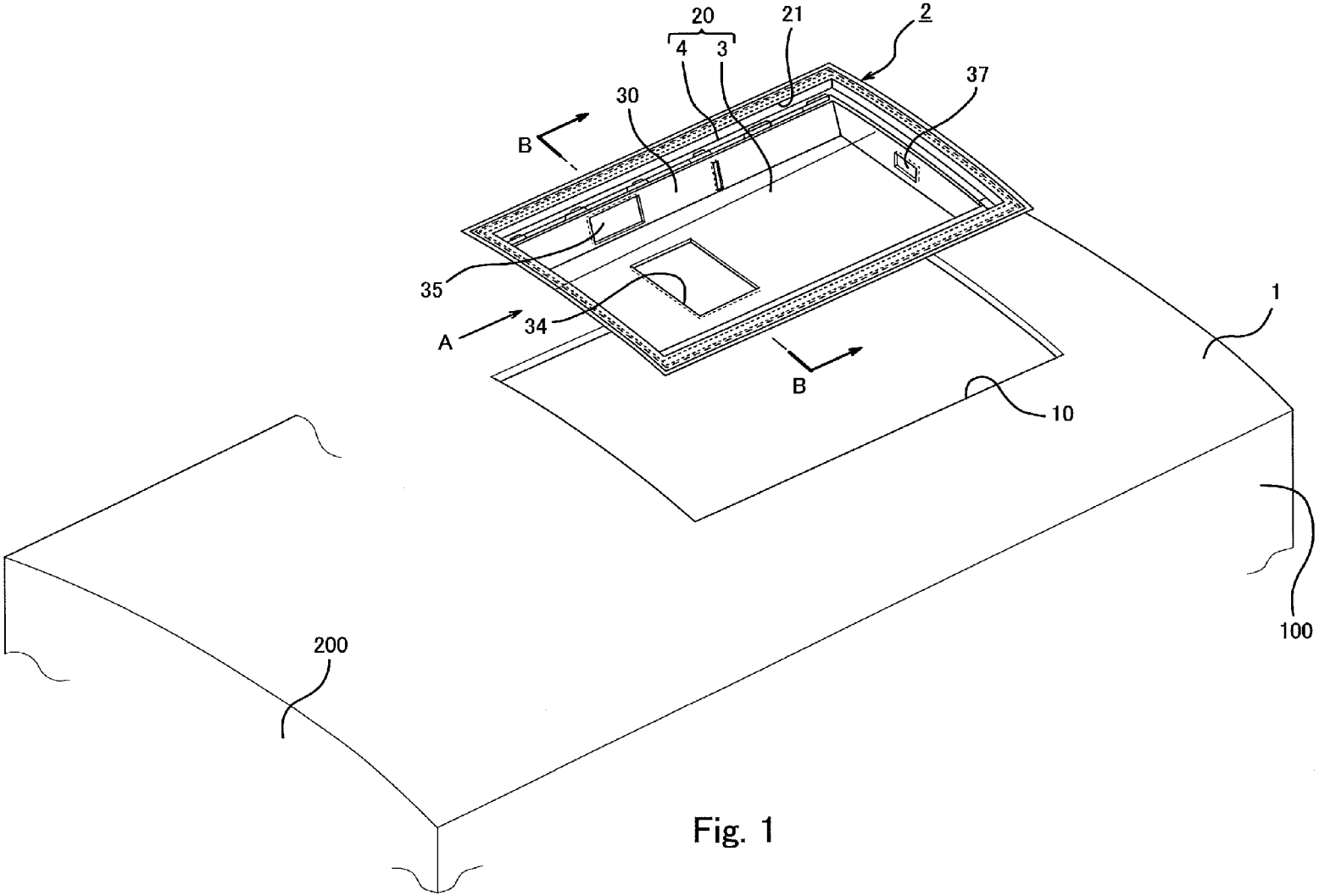
FIG. 1 is a perspective view of a low roof structure of one embodiment.

FIG. 1 is a view illustrating a railroad vehicle structure provided with a low roof structure 2 according to the embodiment. A railroad vehicle structure includes two side structures 100, an underframe (not illustrated) which constitutes the bottom of the vehicle structure, two end structures 200 provided in end parts of the vehicle structure in a vehicle longitudinal direction, and a roof structure 1 including the low roof structure 2 which constitutes the top of the vehicle structure. As illustrated in FIG. 1, the top surface of the roof structure 1 of the railroad vehicle is formed in an arched shape, bulged upwardly. A first opening 10 of a rectangular shape where a low roof main body 20 which is a main body part of the low roof structure 2 can be installed is formed in a substantially central part of the roof structure 1 in a vehicle width direction. In addition, as illustrated in FIG. 3, an arched cover 23 is removably attached to the top of the low roof main body 20 via a sealing member 25 made of rubber to constitute a part of the roof structure 1.

1-2. Configuration of Low Roof Main Body

Figure 2:
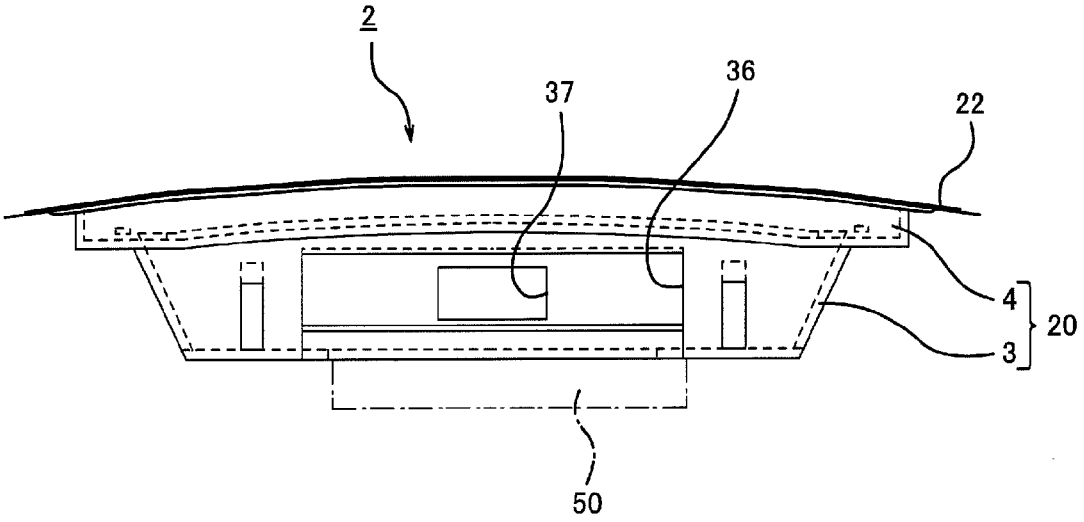
FIG. 2 is a side view of the low roof structure in the A-direction, illustrated in FIG. 1.
Figure 3:
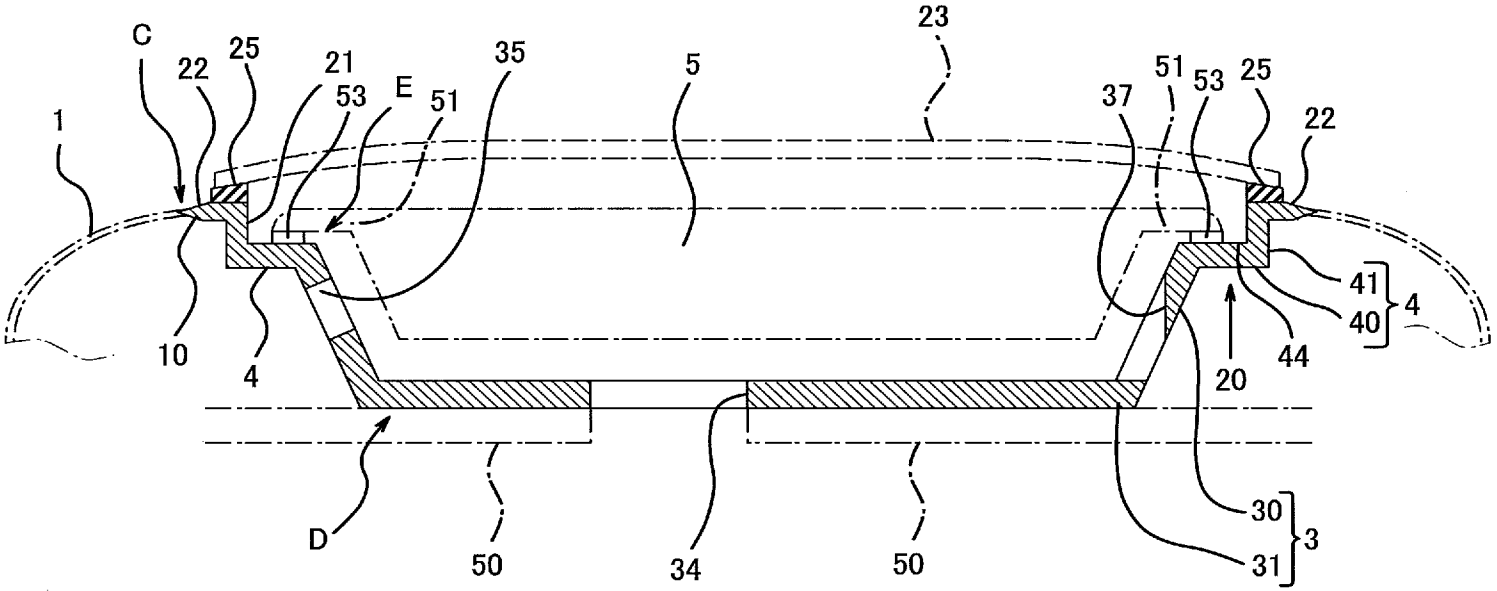
FIG. 3 is a cross-sectional view of the low roof structure illustrated in FIG. 1, taken along a line B-B.

As illustrated in FIGS. 1 to 3, the low roof main body 20 has a rectangular shape in a plan view, and a second opening 21 is formed on the top. The low roof main body 20 includes an edge part 22 provided around the periphery of the second opening 21, a recessed part 3 provided below the edge part 22, and a stepped part 4 which connects the edge part 22 and the top end of the recessed part 3. The edge part 22 is made of reinforced plastic, such as CFRP or GFRP, and is attached to the roof structure 1 via a frame 6. Note that mounting structures of the edge part 22, the frame 6, and the roof structure 1 will be described later.

Figure 4:
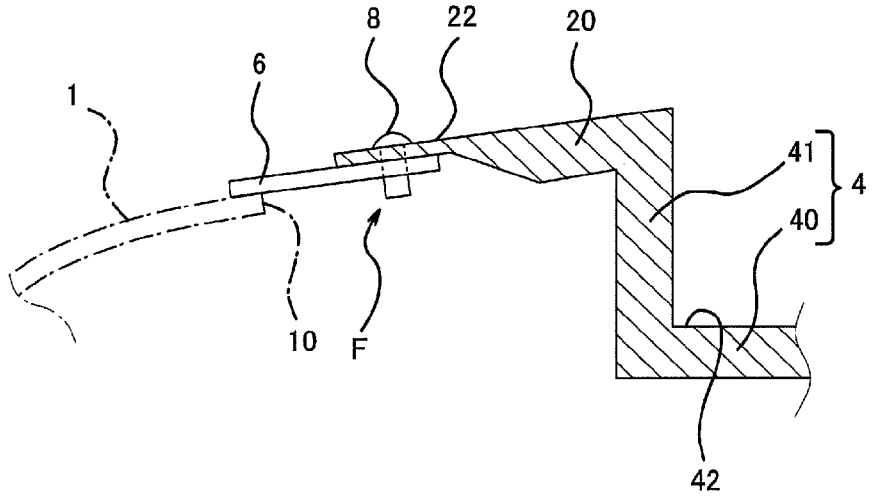
FIG. 4 is an enlarged view of a section C of FIG. 3.

As illustrated in FIGS. 3 and 4, the stepped part 4 has a flat part 40 including a horizontal surface 42 which extends outwardly from the top end of the recessed part 3, and a side wall 41 which extends downwardly from the top end of the low roof main body 20. The flat part 40 and the side wall 41 are formed in all the circumferential surfaces of the low roof main body 20. Although the side wall 41 is formed as a vertical wall in FIG. 4, it is not limited to this and may be inclined. The recessed part 3 has a peripheral wall 30 and a bottom portion 31, and an air conditioner 5 is installed in the recessed part 3. The air conditioner 5 has a leg part 51 in the edge thereof, and the leg part 51 is attached to the flat part 40 of the stepped part 4 via a packing 53 (refer to FIG. 3). That is, the flat part 40 constitutes a placing part 44 on which the air conditioner 5 is placed. The peripheral wall 30 includes, as illustrated in FIGS. 1 and 2, a second opening part 35 which is formed in a side face thereof along the longitudinal direction and through which air flows between the inside and the outside the vehicle. The peripheral wall 30 also includes a third opening part 36 for feeding conditioned air from the air conditioner 5 into the vehicle, and a fourth opening part 37 through which electric wires of the air conditioner 5 and the like pass, where the third opening part 36 and the fourth opening part 37 are each formed in respective short-side side faces of the peripheral wall 30. Note that the peripheral wall 30 is made of reinforced plastic, similar to the edge part 22.

As illustrated in FIGS. 1 and 3, a first opening part 34 for taking air from the inside of the vehicle into the recessed part 3 to lead the air into the air conditioner 5 is formed in the bottom portion 31. Note that, as illustrated in FIG. 2, a ceiling interior plate, as well as vehicle interior lamps 50, hanging bars and the like, are attached to a lower surface of the bottom portion 31, which faces the inside of the vehicle. As illustrated in FIGS. 6 (*a*) and (*b*), the bottom portion 31 has a sandwich structure which is comprised of two face plates 33 made of reinforced plastic and a core member 32 disposed between the face plates 33. Here, the core member 32 has a honeycomb structure as illustrated in FIG. 6(*a*), and it is made of, for example, metal, such as an aluminum alloy or stainless steel, or plastic or paper. Note that, as illustrated in FIG. 6(*b*), foamed resin may also be used for the core member 32. Thus, by forming the bottom portion 31 into the sandwich structure, a sufficient strength can be obtained for attaching the ceiling interior components, and the weight can be reduced as compared with a bone-and-skin structure which is comprised of plate(s) and frames. In addition, by having the sandwich structure, since the thickness of the bottom portion 31 can be reduced, a certain ceiling height of a passenger cabin can be secured within a range of the low roof section and, thus, a sufficient cabin space can be obtained even if the railroad vehicle has the low roof structure.

Note that, as illustrated in FIG. 6(*c*), the bottom portion 31 may also have a corrugated-plate structure made of reinforced plastic and, thus, it can secure a desired rigidity by this structure, while reducing the weight and the thickness. In this case, the bottom portion 31 has a structure where ridge portions 31*a* and valley portions 31*b* are alternately and continuously formed. Further, although the low roof main body 20 is provided with the edge part 22, the recessed part 3, and the stepped part 4, they may be integrally formed. Thus, watertightness, rigidity, assemblability of the low roof main body 20 can be improved, while reducing a manufacturing cost.

1-3. Mounting Structure of Low Roof Main Body and Roof Structure

Figure 5:
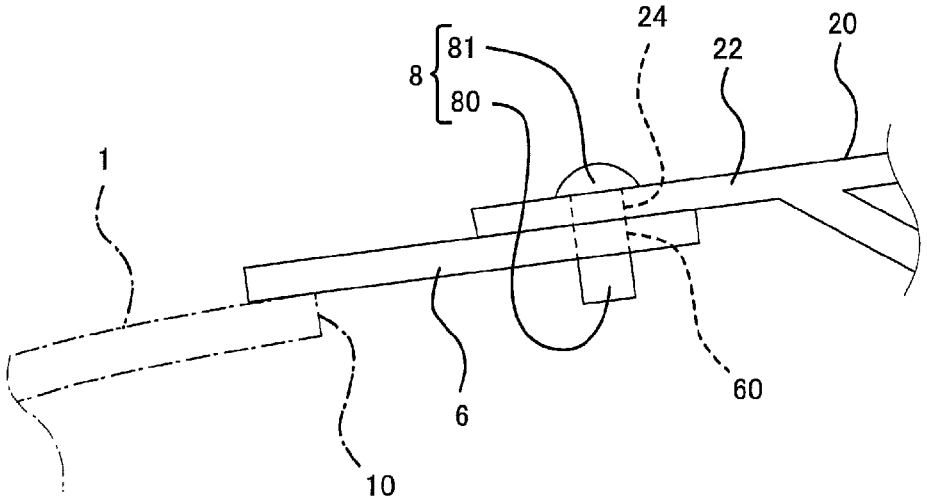
FIG. 5 is an enlarged view of a section F of FIG. 4.

Next, a mounting structure of the low roof main body 20 and the roof structure 1 is described. As illustrated in FIG. 4, the metal frame 6 is welded at one end thereof to an upper surface of an end part of the roof structure 1 on the first opening 10 side. On the other hand, the other end of the frame 6 is arranged underneath the edge part 22 of the low roof main body 20, and is fastened to the edge part 22, for example, with rivets. The frame 6 is formed in a rectangular shape so that it entirely opposes to a lower surface of the edge part 22 in the plan view. FIG. 5 is an enlarged view of a section F of FIG. 4. First through-holes 24 are formed in the edge part 22 of the low roof main body 20, and second through-holes 60 which overlap with the first through-holes 24 are formed at the other end of the frame 6. A stem portion 80 of a rivet 8 is inserted into the first through-hole 24 and the second through-hole 60 from above the edge part 22 of the low roof main body 20, a tip end part of the stem portion 80 is caulked to fasten the frame 6 to the low roof main body 20. Here, sealant is applied to the circumferential surface of a head portion 81 of the rivet 8 to prevent rain water from entering through both the through-holes 24 and 60.

With the above configuration, the reinforced-plastic edge part 22 of the low roof main body 20 will not be damaged by heat of welding. In addition, the circumferential surface of the stem portion 80 of the rivet 8 closely contacts the circumferential surfaces of both the through-holes 24 and 60 when the rivet 8 is caulked. Thus, even if a shearing load is applied to the low roof structure 2 while the vehicle is traveling, since the shearing load is received by the entire circumferential surface of the stem portion 80 of the rivet 8, a joining strength against the shearing load between the frame 6 and the low roof main body 20 can be increased. Further, as illustrated in FIGS. 4 and 5, the edge part 22 of the low roof main body 20, the frame 6, and the roof structure 1 are outwardly arranged to be downward-steps, and they are downwardly inclined toward the outside in the vehicle width direction. Therefore, the rain water and the like will not be accumulated at the fitting part between the edge part 22 and the frame 6 and at the fitting part between the frame 6 and the roof structure 1. Further, even if the frame 6 and the edge part 22 which are joined together come off apart, the low roof main body 20 will not fall.

1-4. Waterproof Structure of Low Roof Structure

Next, a waterproof structure of the low roof structure is described. As illustrated in FIG. 7, the cover 23 is placed on the top of an end part of the edge part 22, while covering the second opening 21. As described above, the cover 23 is applied with simple waterproofing such as a sealing member 25 between the edge part 22 and the cover 23, in order to facilitate attachment and detachment of the cover 23. Thus, when the vehicle is washed or exposed to a large volume of rain water, the water may enter into the low roof main body 20. Therefore, the low roof structure 20 is equipped with the waterproof structure in this embodiment.

That is, as illustrated in FIG. 7, the flat part 40 of the stepped part 4 is provided with a protrusion 45 which protrudes upwardly and is formed continuously all the peripheries of the low roof main body 20, and draining holes 47 formed between the protrusion 45 and the side wall 41. Here, the protrusion 45 may constitute a placing part 44 on which the air conditioner 5 is placed, and the protrusion 45 may be integrally formed with the flat part 40, or the protrusion 45 may be provided as a separate member. Alternatively, the protrusion 45 may be formed into the sandwich structure as illustrated in FIGS. 6(*a*) and (*b*), and, thereby, a sufficient strength can be secured. Note that the protrusion 45 may be made of various materials, such as reinforced plastic, metal or rubber. With such a configuration, even if the rain water or the like falls on the horizontal surface 42 of the low roof main body 20, since the water is dammed up by the protrusion 45, it will not enter into the recessed part 3 and into the vehicle. Further, since the draining holes 47 are formed, the rain water dammed up by the protrusion 45 is discharged outside the vehicle.

1-5. Method of Fitting Low Roof Main Body

When attaching the low roof main body 20 to the roof structure 1, the frame 6 is attached to the roof structure 1 in advance by welding. Then, the low roof main body 20 may be inserted into the first opening 10 from above the first opening 10 to join the frame 6 to the edge part 22 of the low roof main body 20 by the rivets 8. However, the rivets 8 used for joining the frame 6 to the edge part 22 of the low roof main body 20 will actually be hundreds in total number. Thus, in a case where the edge part 22 of the low roof main body 20 is placed on the frame 6 of the roof structure 1, caulking the hundreds of rivets 8 to join the frame 6 to the edge part 22 is a lot of work and, thus, workability is bad. In addition, as described above, although the sealant is applied to the circumferential surfaces of the head portions 81 of the rivets 8, the workability is bad because the sealant must be applied from above the roof structure 1. Because of the badness of the workability, the application of the sealant tends to be non-uniform and, thus, this may cause a trouble in the durability of the sealant as well. Therefore, in this embodiment, the low roof main body 20 is attached to the roof structure 1 by the following procedures.

First, in a process which is different from the process of attaching the low roof main body 20 to the roof structure 1 (for example, a CFRP forming process) the frame 6 is arranged beneath the edge part 22 of the low roof main body 20. The second through-holes 60 are aligned with the first through-holes 24, and the stem portions 80 of the rivets 8 are then inserted from above the edge part 22 of the low roof main body 20 into both the respective through-holes 24 and 60. Next, the bottom end parts of the stem portions 80 of the rivets 8 are caulked to join the frame 6 to the edge part 22 of the low roof main body 20. Then, coating of the sealant is applied to the circumferential surfaces of the head portions 81 of the rivets 8. The low roof main body 20 to which the frame 6 is attached is inserted from above the first opening 10 into the first opening 10. Thus, the frame 6 contacts the edge part 22 of the first opening 10 of the roof structure 1. Then, the frame 6 is attached to the roof structure 1 by welding. By doing so, since the frame 6 can be attached to the edge part 22 of the low roof main body 20 in an exclusive factory, the rivets 8 can be caulked by an automated machine, without human labors. Therefore, the workability becomes better. In addition, since workability also becomes better in the sealant application work, this work can be carried out with high accuracy.

Next, the air conditioner 5 is accommodated in the recessed part 3, and the leg part 51 of the air conditioner 5 is placed on the upper surface of the protrusion 45. Here, alignment protrusions 46 may be formed on the protrusion 45, fitting holes 52 into which the alignment protrusions 46 are fitted may also be formed in a lower surface of the leg part 51, and the alignment protrusions 46 may be provided in the fitting holes 52 (refer to FIG. 7). By wrapping the packing 53 or the like around the alignment protrusions 46 which are fitting parts of the air conditioner 5, it can prevent the rain water and the like from entering into the recessed part 3. Finally, the cover 23 is placed over the second opening 21 of the low roof main body 20.

2. Modification of Low Roof Main Body

Figure 8:
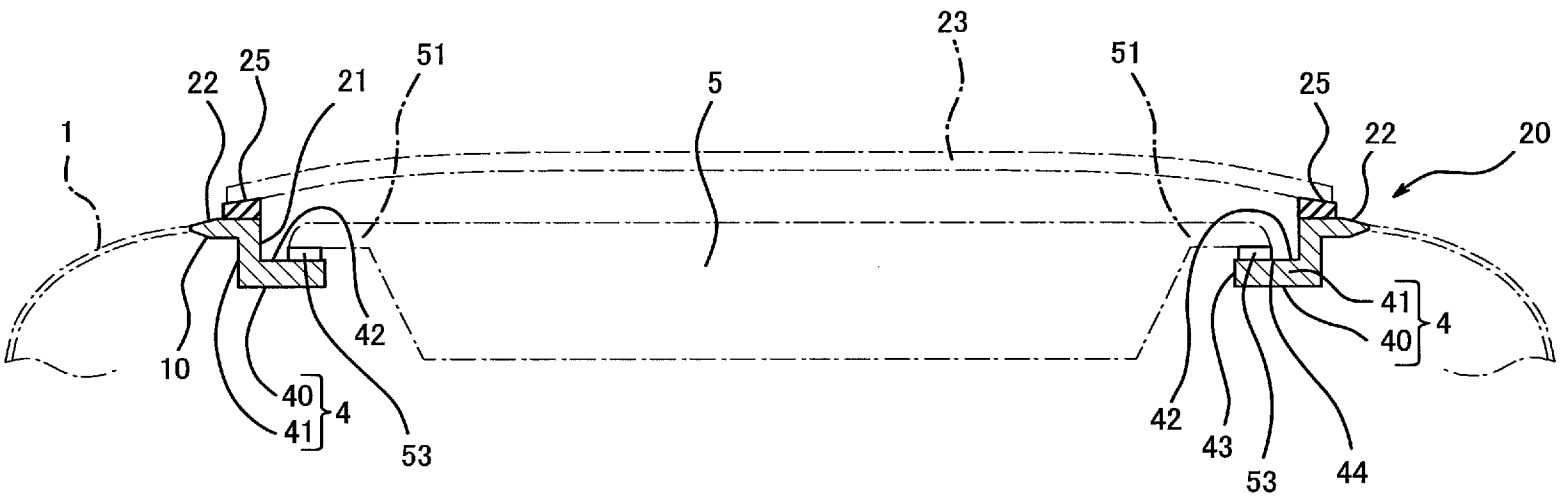
FIG. 8 is a cross-sectional view illustrating a modification of a low roof main body.

FIG. 8 is a cross-sectional view illustrating a modification of the low roof main body 20. In this modification, the low roof main body 20 is provided with an edge part 22 and a stepped part 4, while the recessed part 3 is not formed. This is because the recessed part 3 can be omitted in a case where a load acted onto the roof is not large, or, for example, in a case where interior parts, such as hanging bars, to which a comparatively large load is applied, are not attached to the bottom of the roof structure 1. As described above, the stepped part 4 has a flat part 40 including a horizontal surface 42, and a side wall 41 which extends downwardly from the top end of the low roof main body 20 and is connected to the flat part 40. The stepped part 4 is formed all the peripheries of the low roof main body 20. A pass hole 43 which continues from the second opening 21 is formed at the center of the flat part 40, and the leg part 51 of the air conditioner 5 is placed on the flat part 40, that is, on the horizontal surface 42, which is an edge part of the pass hole 43, via the packing 53. In other words, the flat part 40 forms a placing part 44 of the air conditioner 5. The air conditioner 5 can directly take in air inside the vehicle.

In this modification, since the recessed part 3 is not formed, the entire weight of the low roof main body 20, that is, the entire weight of the roof structure 1 can further be reduced. In addition, by not forming the recessed part 3, a certain height of the passenger cabin ceiling within the range of the low roof section of the vehicle structure can be secured, and it becomes easier to obtain a sufficient vehicle interior space, compared with the case where the recessed part 3 is formed. Note that, although not illustrated in FIG. 8, in order to prevent the rain water and the like which fell onto the horizontal surface 42 from entering into the vehicle, as described in the above embodiment, the protrusion 45 and the draining holes 47 (refer to FIG. 7) may also be formed in the flat part 40. In this case, the protrusion 45 serves as the placing part 44 of the air conditioner 5. The lamps 50 inside the vehicle are directly attached to the inside of the roof structure 1 at locations apart from the air conditioner 5, or to the interior ceiling panel (not illustrated).

3. Modification of Waterproof Structure of Low Roof Structure

Figure 9:
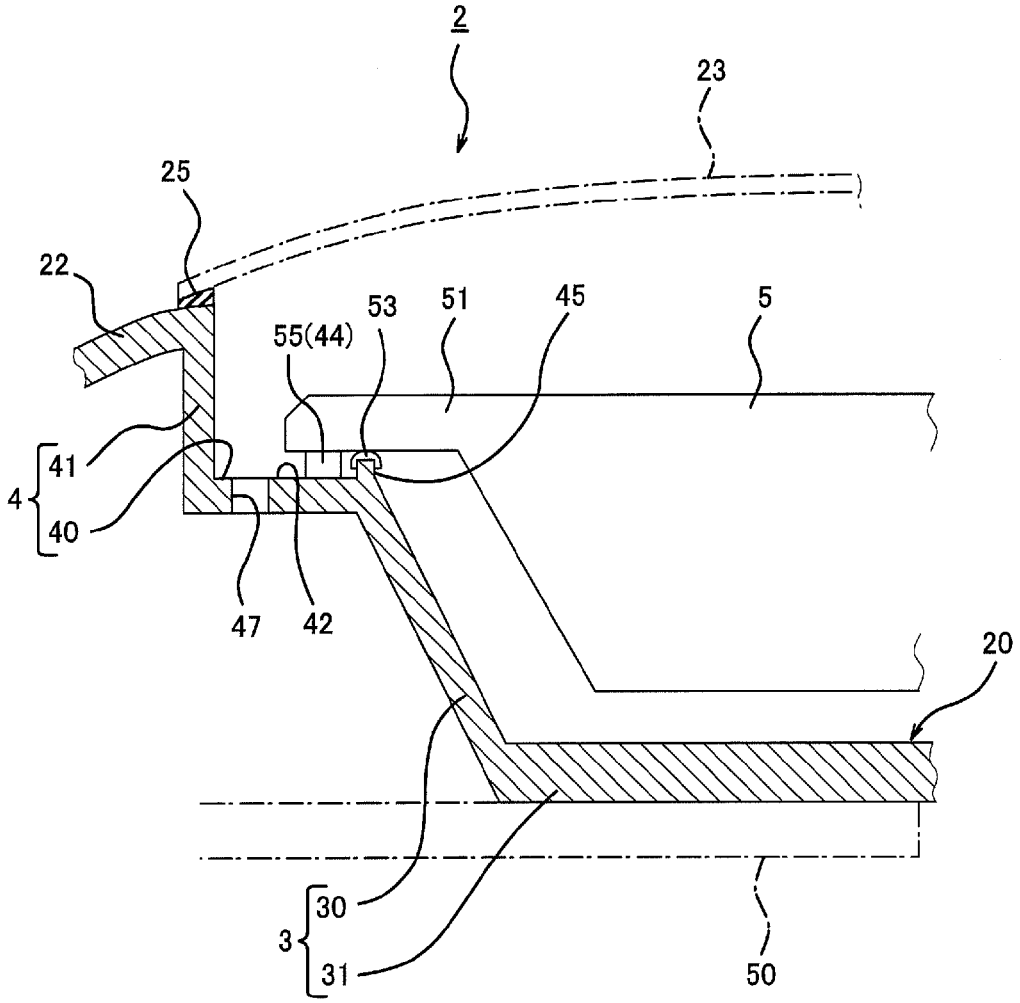
FIG. 9 is a modification of a waterproof structure of the low roof structure illustrated in FIG. 7.

Next, modifications of the waterproof structure of the low roof structure and the installation of the air conditioner 5 will be described. Since other configurations are similar to the configurations of the above embodiment, description thereof is omitted. FIG. 9 is an enlarged view of the horizontal part 42 of the low roof main body 20. In FIG. 9, this configuration is common to the above embodiment illustrated using FIG. 7 in that it is provided with the protrusion 45 which is protruded upwardly at the end of the horizontal part 42, and the draining holes 47 formed between the protrusion 45 and the stepped part 4, but this configuration differs in that it has an attachment base 55 of the air conditioner 5 between the draining holes 47 and the protrusion 45. On the attachment base 55 of the air conditioner 5, the leg part 51 of the air conditioner 5 is placed, and the attachment base 55 constitutes the placing part 44 of the air conditioner 5. In addition, a seal rubber 53 is provided in a gap between the leg part 51 and the protrusion 45. Thus, the rain water does not enter into the recessed part 3, similar to the above embodiment.

4. Other Modifications

In the above embodiment, although the frame 6 is joined to the edge part 22 of the low roof main body 20 with the rivets 8, they may also be joined with adhesives. Alternatively, when forming the low roof main body 20 by autoclave fabrication or fusion fabrication, a co-bond method in which the frame 6 is simultaneously pasted together may also be adopted. In these cases, the application of the sealant onto the head portions 81 of the rivets 8 which is performed when the rivets 8 are used is unnecessary. However, since the frame 6 is joined to the roof structure 1 by welding as described above, heat caused by the welding may be transferred to the edge part 22 of the low roof main body 20 to damage the adhesives and the edge part 22 itself. Particularly, if the contacting area between the frame 6 and the edge part 22 of the low roof main body 20 is large, the quantity of heat caused by the welding and transferred to the edge part 22 of the low roof main body 20 is also large.

Therefore, in such a case, the frame 6 is to be welded to the roof structure 1 by low-heat-input welding, such as laser welding, laser arc hybrid welding, or CMT (Cold Metal Transfer). Thus, the quantity of heat caused by the welding and transferred to the edge part 22 of the low roof main body 20 at the time of welding can be reduced, and the damages to the adhesives or the edge part 22 itself can also be reduced. Of course, when joining the frame 6 to the edge part 22 of the low roof main body 20 with the rivets 8, the low-heat-input welding may also be used for welding the frame 6 to the roof structure 1.

Further, the frame 6 may be joined to the edge part 22 of the low roof main body 20 by using bolts. Alternatively, they may be joined using various combinations, such as rivets and adhesives, or bolts and adhesives. Note that, alternatively to the above embodiment, a sandwich structure where the peripheral wall 30 may be comprised of face plates and a core member. Further, in the above embodiment, although CFRP or GFRP are used as one example, the material may be, but not limited to, other reinforced plastics. Further, in the above embodiment, the leg part 51 of the air conditioner 5 is placed on the flat part 40. However, alternatively to this configuration, a spacer (not illustrated) may be provided to the bottom portion 31 of the recessed part 3, and the bottom of the air conditioner 5 may be placed on the spacer.

5. Effects of Each Configuration

In each of the embodiments, the roof structure has the metal frame extending toward the opening, and the frame is joined to the roof structure and the edge part of the low roof main body. With this configuration, the frame can be joined to the roof structure by welding and, thus, the workability is good. In each of the embodiments, the roof structure has the metal frame extending toward the opening, and the frame is joined to the edge part of the low roof main body by the rivets or the adhesives. With this configuration, since the frame can be joined in advance to the edge part of the low roof main body which is made of reinforced plastic with the rivets or the adhesives, the workability, quality, and strength of the joining of both can be improved.

In each of the embodiments, the roof structure has the metal frame extending toward the opening, the upper surface of the frame is joined at one end to the lower surface of the edge part of the low roof main body, and the lower surface of the frame is joined at the other end to the upper surface of the roof structure. With this configuration, since the edge part of the low roof main body, the frame, and the roof structure are arranged descending in a stepwise toward the outside, and they are inclined downwardly toward the outside in the vehicle width direction, the rain water and the like will not be accumulated at the fitting part between the edge part and the frame, or the fitting part between the frame and the roof structure. In addition, even if the frame and the edge part which are joined together come off apart, the low roof main body will not fall. In each of the embodiments, the roof structure has the metal frame extending toward the opening, one end of the frame is joined to the edge part of the low roof main body, and the other end of the frame is joined to the roof structure by the low-heat-input welding. With this configuration, since the frame is joined to the roof structure by the low-heat-input welding, the edge part of the low roof main body made of reinforced plastic does not deteriorate by the heat of welding.

In each of the embodiments, the low roof main body further has the stepped part including the placing part inside the edge part of the low roof main body, and the placing part of the stepped part includes the protrusion extending upward in the vertical direction. Further, the draining holes are formed between the protrusion and the edge part of the low roof main body. With this configuration, even if the rain water enters through the edge part of the low roof main body, the rain water is dammed up by the protrusion and, thus, the rain water is prevented from entering into the recessed part or the air conditioner. In addition, the rain water can be discharged outside the roof structure via the draining holes. Although the protrusion can also be used as an attachment base of the air conditioner, the configuration of the attachment base can be made simpler if the protrusion which achieves the waterproof function is separately formed from the attachment base of the air conditioner. With this configuration, the stepped part and the protrusion can be integrally formed. In addition, since the protrusion can also be formed into the sandwich structure, sufficient strength can be secured.

In each of the embodiments, the bottom of the recessed part has the sandwich structure having the two face plates made of reinforced plastic and the core member formed between the face plates. In addition, the core member may also be formed in a honeycomb structure or may also be made of foamed resin. With this configuration, sufficient strength can be secured while reducing the weight, compared with the case where the bottom of the recessed part is entirely made of metal. In each of the embodiments, the bottom of the recessed part has the corrugated-plate structure made of reinforced plastic where the ridge portions and the valley portions are continuously formed in the vehicle width direction. With this configuration, sufficient strength can be secured while reducing the weight, compared with the case where the bottom of the recessed part is entirely made of metal. In addition, since it can have the thin-plate structure, the sufficient ceiling height of the passenger cabin can be obtained.

In each of the embodiments, the cover member which covers the upper part of the low roof main body is further provided, and the bottom surface of the end part of the cover member is placed on the top surface of the end part of the recessed part of the edge part of the low roof main body via the sealing member. With this configuration, waterproof performance can be secured, while the cover member can easy be detachable from the low roof main body. According to the above description, many improvements and other embodiments of the present invention are apparent for the person skilled in the art. Therefore, the above description is intended to be interpreted only as illustration, and it is to provide in order to teach the person skilled in the art one mode for carrying out the present invention. Details of the structures and/or the functions can be substantially changed without departing from the scope of the present invention.

INDUSTRIAL APPLICABILITY

The present invention is useful if it is applied to the railroad vehicle provided with the low roof structure.

DESCRIPTION OF REFERENCE NUMERALS

1 Roof Structure
2 Low Roof Structure
3 Recessed Part
4 Stepped Part
5 Air Conditioner
6 Frame
8 Rivet
10 First Opening
20 Low Roof Main Body
21 Second Opening
22 Edge Part
23 Cover
24 First Through-Hole
30 Peripheral Wall
31 Bottom Portion
34 First Opening Part
35 Second Opening Part
36 Third Opening Part
37 Fourth Opening Part
40 Flat Part
41 Side Wall Part
42 Horizontal Surface
43 Pass Hole
44 Placing Part
45 Protrusion
47 Draining Hole
50 Interior Plate
60 Second Through-Hole
80 Stem Portion
81 Head Portion
100 Side Structure
200 End Structure

What is claimed is:

1. A railroad vehicle comprising:

a roof structure having an air conditioner installation opening for receiving an air conditioner; and a low roof main body provided in the opening, the low roof main body including:

a recessed part recessed into the roof structure in a vertical direction of the railroad vehicle away from an upper surface of the roof structure, the recessed part being a lowest portion of the low roof main body in the vertical direction;

a placing part configured to receive the air conditioner on an upper surface of the placing part, the placing part being flat and horizontal in a width direction of the railroad vehicle, the placing part being connected to the recessed part and extending outward away from the recessed part in the width direction of the railroad vehicle, the placing part being disposed above the recessed part in the vertical direction, and the recessed part extending downward in the vertical direction from the placing part; and an edge part formed integrally as one piece with the low roof main body and joined to the roof structure, the edge part being located above the placing part in the vertical direction, the edge part defining an outer edge of the low roof main body, the placing part being disposed between the edge part and the recessed part in the vertical direction, the placing part extending between the edge part and the recessed part, wherein the low roof main body and the edge part of the low roof main body are made of plastic.

2. The railroad vehicle of claim 1, wherein the roof structure has a metal frame extending toward the opening, and the frame, the roof structure, and the edge part of the low roof main body are joined together.

3. The railroad vehicle of claim 1, wherein the roof structure has a metal frame extending toward the opening, and the frame and the edge part of the low roof main body are joined together with rivets or adhesives.

4. The railroad vehicle of claim 1, wherein the roof structure has a metal frame extending toward the opening, a lower surface of the edge part of the low roof main body and an upper surface of one end part of the frame are joined together, and the upper surface of the roof structure and a lower surface of another end part of the frame are joined together.

5. The railroad vehicle of claim 1, wherein the roof structure has a metal frame extending toward the opening, one end part of the frame is joined to the edge part of the low roof main body, and another end part of the frame is joined to the roof structure by low-heat-input welding.

6. The railroad vehicle of claim 1, wherein a bottom part of the recessed part comprises a sandwich structure having two face plates made of reinforced plastic and a core member provided between the face plates.

7. The railroad vehicle of claim 6, wherein the core member is a honeycomb structure or the core member is made of foamed resin.

8. The railroad vehicle of claim 1, wherein a bottom part of the recessed part is formed in a corrugated plate structure made of reinforced plastic, the bottom part forming alternate ridge portions and valley portions that extend in a vehicle width direction.

9. The railroad vehicle of claim 1, further comprising a cover member covering an upper part of the low roof main body, wherein a lower surface of an end part of the cover member is placed via a sealing member onto an upper surface of an end part of the edge part of the low roof main body on a side of the edge part closer to the recessed part.

10. The railroad vehicle of claim 1, wherein at least the low roof main body and the edge part of the low roof main body are integrally formed.

11. The railroad vehicle of claim 1, wherein the bottom portion is disposed at a bottom of the recessed part in the vertical direction, and the placing part is disposed above the bottom part and below the edge part.

12. The railroad vehicle of claim 1, further comprising an air conditioner having a leg part at an edge of the air conditioner, the air conditioner being installed in the recess part via the leg part, wherein a position of an upper surface of the installed air conditioner is lower than the edge part of the low roof main body.

13. A railroad vehicle comprising:

a roof structure having an air conditioner installation opening for receiving an air conditioner;

a low roof main body provided in the opening, the low roof main body including:

a recessed part recessed into the roof structure in a vertical direction away from an upper surface of the roof structure, the recessed part including a placing part configured to receive the air conditioner on an upper surface of the placing part, the placing part being flat and horizontal in a width direction of the railroad vehicle, and an edge part formed integrally as one piece with the low roof main body and joined to the roof structure, and being located above the placing part, the edge part defining an outer edge of the low roof main body, the placing part being disposed between the edge part and a bottom portion of the recessed part in the vertical direction, wherein the low roof main body and the edge part of the low roof main body are made of plastic, the edge part of the low roof main body has a stepped part that includes the placing part, and the placing part has a protrusion that extends upwardly in the vertical direction, a draining hole being provided between the protrusion and the edge part of the low roof main body.

14. The railroad vehicle of claim 13, wherein the protrusion is an attachment base of the air conditioner.

* * * * *